US006852372B2

(12) United States Patent
Horikoshi et al.

(10) Patent No.: US 6,852,372 B2
(45) Date of Patent: Feb. 8, 2005

(54) FABRICATION METHOD FOR ELECTRON SOURCE SUBSTRATE

(75) Inventors: Michio Horikoshi, Ibaraki (JP); Hiroyuki Otsuka, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/681,311

(22) Filed: Oct. 9, 2003

(65) Prior Publication Data

US 2004/0077111 A1 Apr. 22, 2004

(30) Foreign Application Priority Data

Oct. 17, 2002 (JP) ..... 2002-303163

(51) Int. Cl.[7] ..... B05D 3/06
(52) U.S. Cl. ..... 427/558
(58) Field of Search ..... 427/558; 313/422; 445/6, 24; 315/169.1

(56) References Cited

U.S. PATENT DOCUMENTS 6,210,245 B1 * 4/2001 Sando et al. ..... 445/6
6,220,912 B1 * 4/2001 Shigeoka et al. ..... 445/24
6,383,047 B1 * 5/2002 Minami et al. ..... 445/6
6,426,588 B1 * 7/2002 Yanagisawa ..... 313/422
6,426,733 B1 * 7/2002 Yamada ..... 345/74.1
6,613,399 B2 * 9/2003 Miyamoto et al. ..... 427/558

* cited by examiner

*Primary Examiner*—John F. Niebling
*Assistant Examiner*—Andre' C. Stevenson
(74) *Attorney, Agent, or Firm*—Fitzpatrick, Cella, Harper & Scinto

(57) ABSTRACT

A fabrication method for an electron source substrate comprises: a measurement step wherein at least one of a substrate, having a plurality of pairs of electrodes on the surface thereof, and measurement means for measuring the position of the substrate in at least one direction of the mutually orthogonal XYZ directions, is scanned relatively in one direction, thereby measuring the substrate position; a control step for controlling the discharge position of droplets containing electroconductive thin-film material onto the substrate from an ink-jet head, based on the measurement results; and a discharge step for discharging the droplets between the pairs of electrodes while relatively scanning at least one of the ink-jet head and substrate in one direction; wherein the scanning direction in the measurement step and the scanning direction in the discharge step are generally parallel; and wherein the measurement step and the discharge step are performed in a single scan.

9 Claims, 6 Drawing Sheets

FABRICATION METHOD FOR ELECTRON SOURCE SUBSTRATE

BACKGROUND OF THE INVENTION

1. Field of the Invention

The present invention relates to a fabrication method for fabricating an electron source substrate comprising an array of multiple electron emission devices each having a pair of device electrodes and an electroconductive thin film connecting the device electrodes, with a electron emission portion formed on the electroconductive thin film and a substrate.

2. Description of the Related Art

An electron source substrate is a substrate used for a display, comprising an array of multiple electron emission devices each having a pair of device electrodes on an insulating substrate and an electroconductive thin film connecting the device electrodes, with an electron emission portion formed on the electroconductive thin film, and particularly involve surface-conduction-type electron-emitting devices as electron sources.

Conventionally, two general types of electron-emitting devices are known; thermionic emitters and cold-cathode emitters. There are different types of the cold-cathode emitters, such as electron emission types (hereafter referred to as "FE type"), metal-insulating-metal types (hereafter referred to as "MIM type"), surface-conduction-type electron-emitting devices, and so forth.

Known examples of an FE type include that disclosed by W. P, Dyke & W. W. Dolan in "Field Emission", Advance in Electron Physics, 8, 89 (1956), and C. A. Spindt in "Physical Properties of Thin-Film Field Emission Cathodes with Molybdenum Cones", J. Appl. Phys 47, 5248 (1976).

On the other hand, as for MIM types, that disclosed by C. A. Mead in "Operation of Tunnel-Emission Devices" J. Appl. Phys., 32, 646 (1961) is known.

Further, known examples of a surface-conduction-type electron-emitting device include that disclosed by M. I. Elinson in "Radio Eng. Electron Phys., 10, 1290" (1965), and so forth. A surface-conduction-type electron-emitting device takes advantage of a phenomenon wherein electron emission is generated by applying a current to a small-area thin film formed on a substrate, the current being applied in parallel to the face of the film. Reported examples of such surface-conduction-type electron-emitting devices include those using a $SnO_2$ thin film (Elinson et al), this using Au thin film (G. Dittmer, "Thin Solid Films", 9, 317 (1972)), those using $In_2O_3/SnO_2$ thin film (M. Hartwell and C. G Fonstad "IEEE Trans. ED Conf.", 519 (1975)), those using carbon thin film (Hisashi Araki et al. "Journal of the Vacuum Society of Japan", vol. 26, No. 1, p. 22 (1983)), and so forth.

FIG. 5 shows a typical example of the surface-conduction electron-emitting device, according to M. Hartwell described above. In the figure, reference numeral 11 denotes a glass substrate, and 12 and 13 denote a pair of device electrodes formed so as to face each other on the glass substrate. Reference numeral 14 denotes an electroconductive thin film of a metal oxide thin film which has been formed in an H-shaped pattern by sputtering or the like, and an electron emission portion 15 formed by an electrification process called "energization forming". Spacing L between the device electrodes of the surface-conduction electron-emitting device is set between 0.5 to 1 mm, and the width W thereof is set to 0.1 mm. The position and shape of the electron emission portion 15 is represented schematically, since the position and shape thereof is indeterminant.

A method of producing a surface-conduction electron-emitting device, wherein a liquid containing an electroconductive thin-film material applied in the form of a droplet is provided between a pair of electrodes, the condition of providing the droplet between the electrodes is detected, and the droplet is provided between the electrodes based on the information obtained regarding the condition of providing, is disclosed as an inexpensive and simple method for producing an electron source substrate (EP717428A, corresponding Japanese Patent Laid-Open No. 9-69334).

Also disclosed is a method for forming a plurality of electroconductive films electrically connected to a common line, comprising: a step for detecting the displacement condition of the common line or a member accessory to the common line; a step for calculating positional information concerning a plurality of locations where electroconductive film material is to be provided to be electrically connected to the common line based on the results of the detection; and a step for providing the electroconductive film material at the plurality of locations, based on the positional information (EP936652A, corresponding Japanese Patent Laid-Open No. 2000-251665).

However, as the size of the area where droplets are provided increases along with the size of the substrate increasing, it becomes extremely difficult to maintain the overall positional precision of the electrodes on the entire substrate (or substitutes thereof) at a level the same as with smaller-sized substrates, i.e., to keep the distortion at the same level, and also, precision regarding irregularities in the thickness of the substrate tends to deteriorate. Accordingly, there is a need to increase the number of measurement points to measure the position of the device electrodes as compared to conventional arrangements in order to provide the precise discharging of droplets to all device electrode positions on the substrate.

Also, there is a need to repeat the action of moving and positioning the substrate so that the device electrode pattern is in the field of view of a measurement optical system, and then control the position of the substrate within the focal range of the optical system to measure the pattern position, for each of the measurement points. This means an increase in the number of measurement points results in a proportionate increase in the amount of time necessary to measure the multiple device electrodes.

SUMMARY OF THE INVENTION

The present invention has been made in light of the above-described problems, and accordingly, it is a first object of the invention to reduce the amount of time necessary for measuring target positions on the surface of the substrate which is the first step of the conventional process, in order to enable precise and high-speed discharging of the solution containing the metal in a droplet state.

It is a second object of the invention to do away with the difference in time between measurement of the target position on the substrate and the time of discharging droplets, thereby doing away with error from thermal expansion due to a change in the temperature of the substrate and so forth.

It is a third object of the invention to provide a fabricating method and fabricating apparatus of an electron source substrate using high-speed and high-precision droplet providing technology which discharges and provides the droplets while measuring the target pattern.

According to a first aspect of the present invention, a fabrication method for an electron source substrate comprises: a measurement step wherein at least one of a substrate having a plurality of pairs of electrodes on the surface thereof and measurement means for measuring the position of the substrate in at least one direction of the X, Y, and Z directions of the substrate which are mutually orthogonal, is scanned relatively in one direction, thereby measuring the substrate position; a control step for controlling the discharge position of droplets to the substrate from an ink-jet head for discharging droplets containing electroconductive thin-film material, based on the results of the measurement step; and a discharge step for discharging droplets containing electroconductive thin-film material from the ink-jet head to between pairs of electrodes on the surface of the substrate while relatively scanning at least one of the ink-jet head and the substrate in one direction; wherein the scanning direction in the measurement step and the scanning direction in the discharge step are generally parallel; and wherein the measurement step and the discharge step are performed in a single scan.

The measurement means and the ink-jet head may be integrally formed, and the measurement means and the ink-jet head may be disposed in parallel to the scanning direction in the measurement step or the discharge step, or the measurement means and the ink-jet head may be disposed orthogonal to the scanning direction in the measurement step or the discharge step.

The discharge timing of droplets from the ink-jet head may be controlled in the control step, and the scanning direction of the at least one of the ink-jet head and the substrate being relatively scanned in one direction may be controlled in the control step.

The fabrication method may further comprise a preliminary discharge step for performing preliminary discharge of droplets from the ink-jet head, before the discharge step.

The electron source may be configured of surface-conduction emission devices. In this case, the fabrication method may further comprise a forming step for performing energization forming on an electroconductive thin film formed by droplets provided by the discharge step.

In the measurement step, Z-measurement means may measure a plurality of positions on the substrate surface in the Z-direction, with substrate being moved in the Z direction based on the measurement results made by the Z-measurement means, and a plurality of patterns on the substrate being optically recognized by X-Y measurement means followed by image processing, thereby measuring a plurality of positions of the patterns in the X and Y directions.

A plurality of ink-jet heads may be disposed for discharging droplets, with the measuring means provided near each.

Further objects, features and advantages of the present invention will become apparent from the following description of the preferred embodiments with reference to the attached drawings.

DESCRIPTION OF THE PREFERRED EMBODIMENTS

Figure 1:
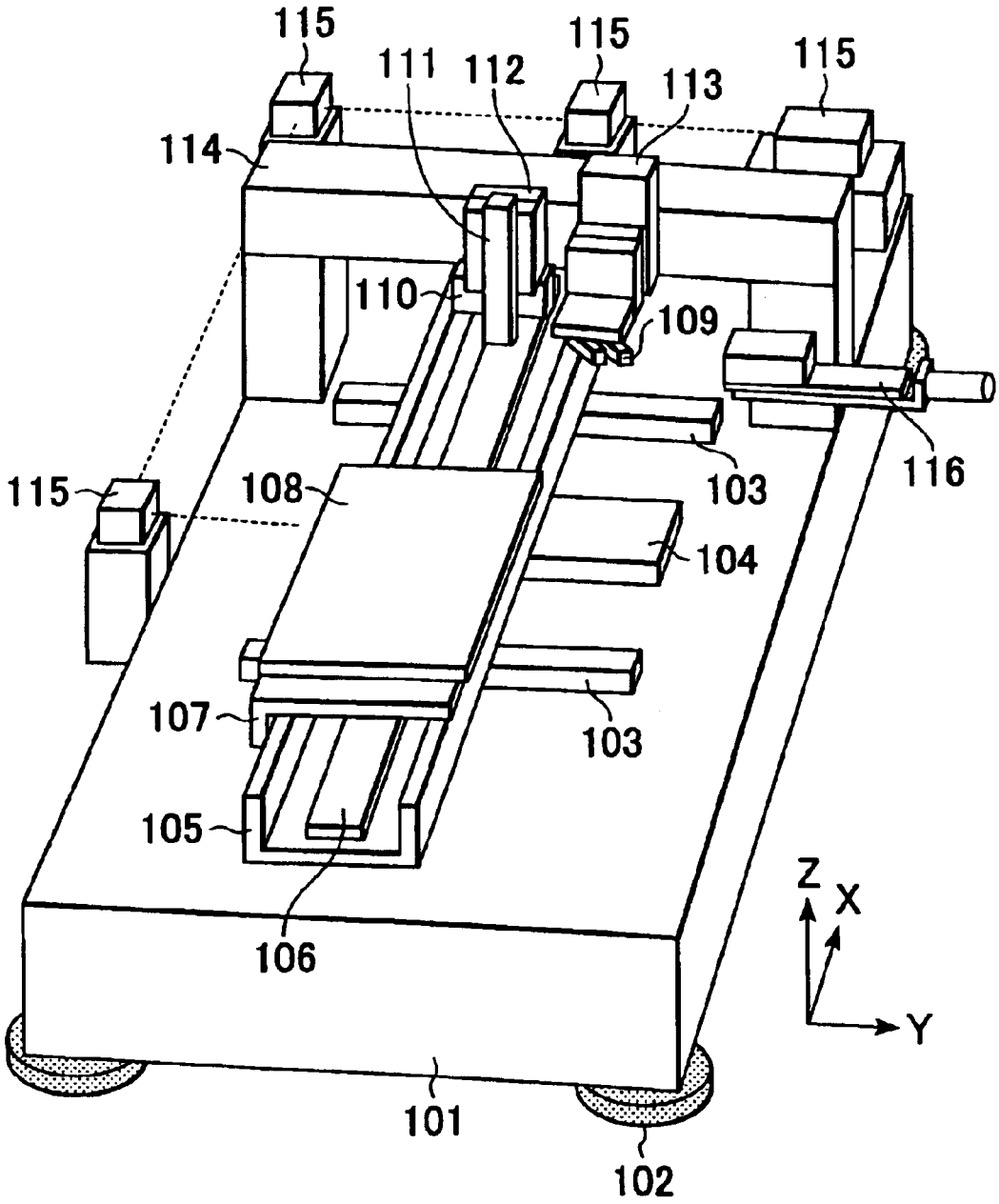
FIG. 1 is a schematic drawing of a fabrication apparatus for an electron source substrate according to a first embodiment of the present invention.

A preferred embodiment of the present invention will be described with reference to the attached drawings. FIGS. 3A through 3D are schematic diagrams illustrating an example of a method for manufacturing of an electron emission device according to the present invention, FIG. 4A is a plan view illustrating an example of a surface-conduction electron emission device manufactured with the manufacturing method according to the present invention, and FIG. 4B is a cross section of that shown in FIG. 4A.

In FIGS. 3A through 4B, reference numeral 11 denotes a substrate, 12 and 13 denote device electrodes, 14 denotes an electroconductive thin film, 15 denotes an electron emission portion, 31 (FIG. 3B) denotes a droplet discharging head, and 32 (FIG. 3B) denotes a droplet.

The method for manufacturing the electron emission devices will be described in order, including the previous and following steps.

Figure 3A:
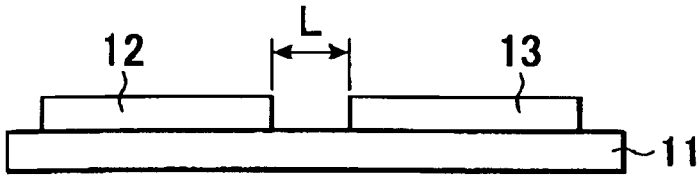
FIGS. 3A through 3D are schematic diagrams illustrating an example of the manufacturing method of an electron emission device with the manufacturing method according to the present invention.
Figure 3B:
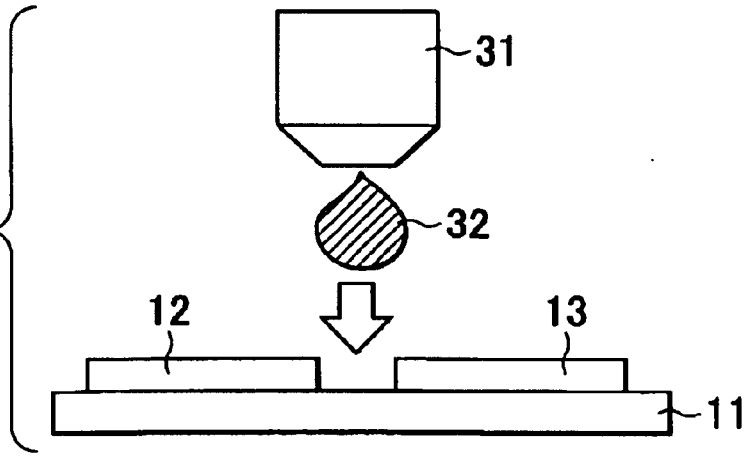
Figure 3C:
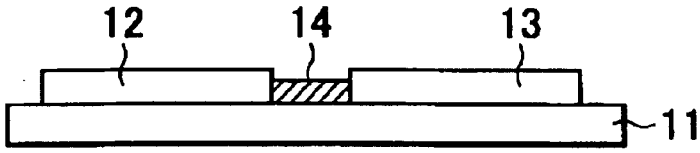
Figure 3D:
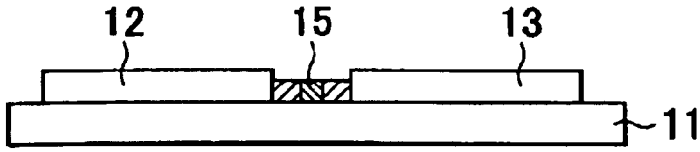
Figure 4A:
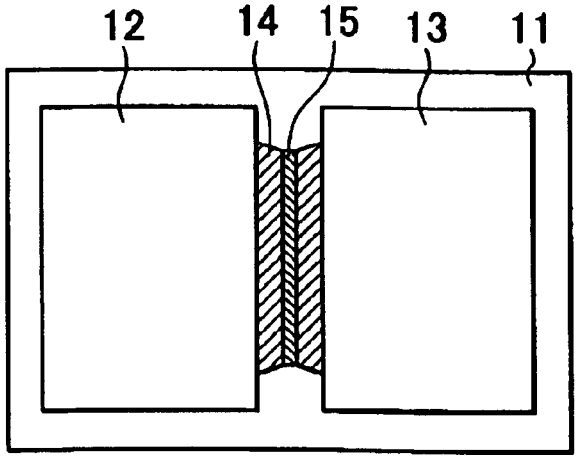
FIG. 4A is a plan view illustrating an example of a surface-conduction electron emission device manufactured with the manufacturing method according to the present invention.
Figure 4B:
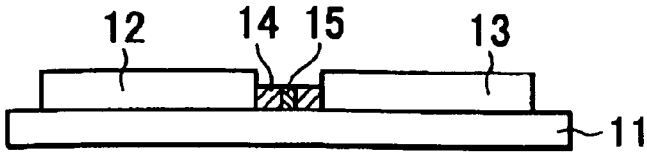
FIG. 4B is a cross section of that shown in FIG. 4A.
Figure 5:
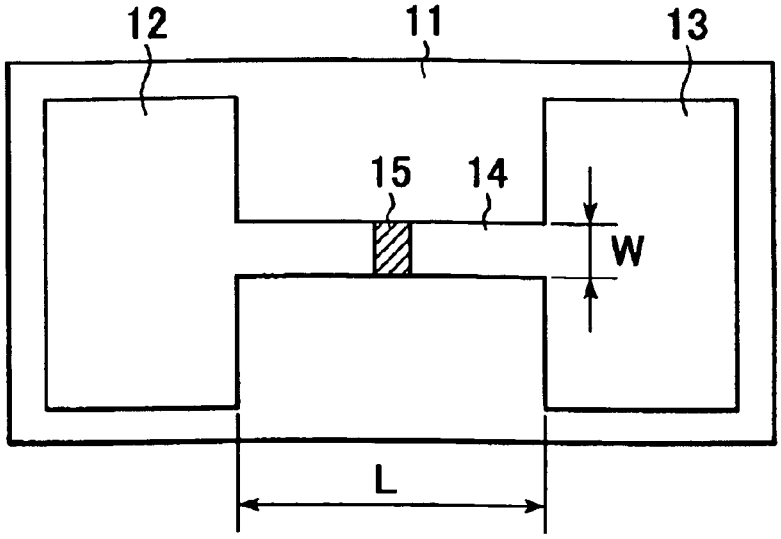
FIG. 5 is a model diagram of a conventional surface-conduction electron emission device.

First, in the previous step in the present invention, device electrodes 12 and 13 are formed on the substrate 11 with a distance L therebetween (FIG. 3A). Next, the apparatus according to the present invention is used to discharge a droplet 32 formed of a solution containing a metal element from the droplet discharging head 31 (FIG. 3B), and the electroconductive thin film 14 is formed so as to be in contact with the device electrodes 12 and 13 (FIG. 3C). Next, a fissure is created in the electroconductive thin film by forming, for example, thereby forming the electron emission portion 15 (FIG. 3D).

The method for forming the device electrodes and the method for forming the electron emission portion by forming processing are described in the conventional examples (Japanese Patent Laid-Open No. 9-69334 and Japanese Patent Laid-Open No. 2000-251665) and so forth, and accordingly description thereof will be omitted here.

An ink-jet head is preferable for the droplet discharging head, since control can be made in the range of proximately 10 to 100 ng, and minute droplets having a size of proximately 10 to 100 ng can be easily formed. Examples of ink-jet heads include ink-jet discharge heads using piezoelectric devices, so-called bubble jet heads wherein bubbles are formed within the liquid by thermal energy so as to discharge the liquid as droplets, and so forth.

A fine particle film is particularly preferable for the electroconductive thin film 14 in order to obtain good electron discharge properties, and though the thickness thereof is suitably set according to conditions such as the step coverage as to the device electrodes 12 and 13, and the resistance between the device electrodes 12 and 13 and the energization forming conditions, and so forth, the thickness is preferably several Å to several thousand Å, and more preferably in the range of 10 Å to 500 Å.

Most characteristic of the fabrication method and fabrication apparatus for the electron source substrate according to the present invention is: a measurement step wherein at least one of a substrate having a plurality of pairs of electrodes on the surface thereof and measurement means for measuring the position of the substrate in at least one direction of the X, Y, and Z directions of the substrate which are mutually orthogonal, is scanned relatively in one direction, thereby measuring the substrate position; a control step for controlling the discharge position of droplets to the substrate from an ink-jet head for discharging droplets containing electroconductive thin-film material, based on the results of the measurement step; and a discharge step for discharging droplets containing electroconductive thin-film material from the ink-jet head to between pairs of electrodes on the surface of the substrate while relatively scanning at least one of the ink-jet head and the substrate in one direction; wherein the scanning direction in the measurement step and the scanning direction in the discharge step are generally parallel; and wherein the measurement step and the discharge step are performed in a single scan.

The object of scanning in the measurement step and the discharge step of the present invention is preferably the substrate. In this case, moving only the substrate with the head and measurement means stationary enables relative scanning of the substrate as to the head and measurement means.

Figure 6:
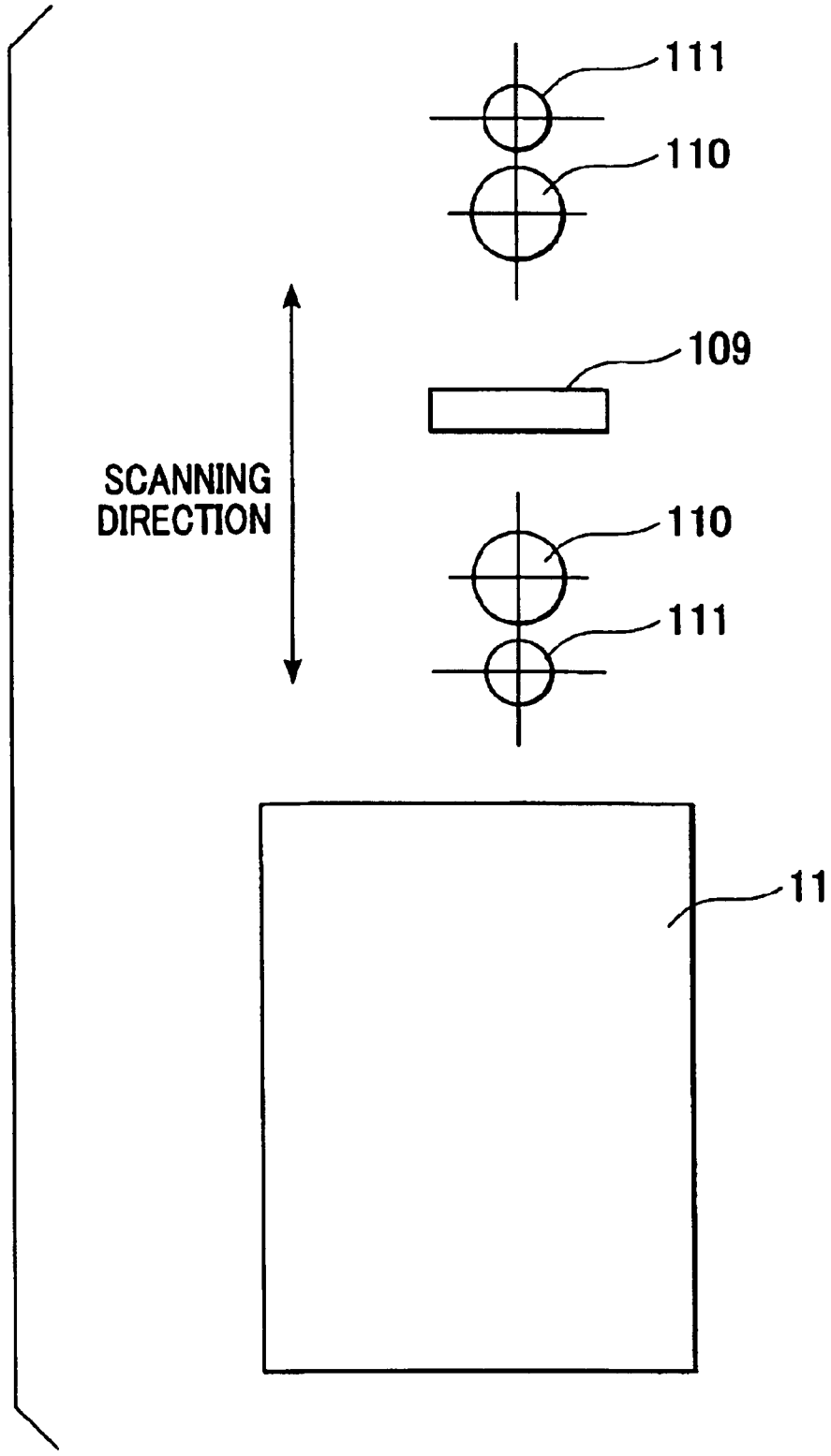
FIG. 6 is a planar displacement diagram of an example of an apparatus wherein two measurement devices have been provided, in front of and behind a head, parallel to a scanning direction of a substrate.
Figure 7:
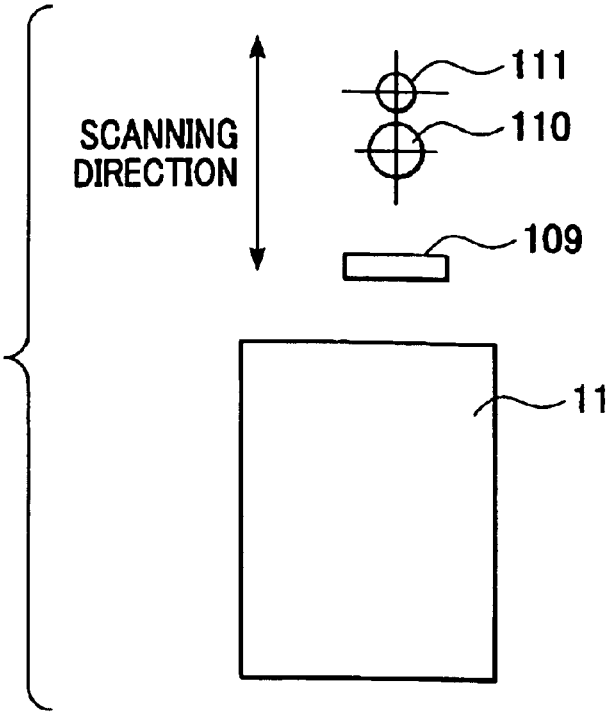
FIG. 7 is a planar displacement diagram of an example of an apparatus wherein a measurement device has been provided only in front of a head, parallel to the scanning direction of a substrate.

Also, various arrangements can be conceived for the placement of the measurement device for measuring the position of the substrate, but a position as close to the head as possible is preferable in any case. For example, in the event that two measuring devices are disposed as shown in FIG. 6, one in front of the head and one behind parallel to the scanning direction of the substrate, the desired position for discharging the droplet can be measured in both the front and back directions, but this requires extra time for scanning the distance between the head and the measurement devices. Also, an arrangement may be made wherein a measurement device has been provided only in front of the head, parallel to the scanning direction of the substrate, as shown in FIG. 7, so as to measure the desired position for discharging the droplet when in one of the forward and backward directions, to store the desired position data, and use the stored data for the other direction, but this also requires extra time for scanning the distance between the head and the measurement devices.

Figure 8:
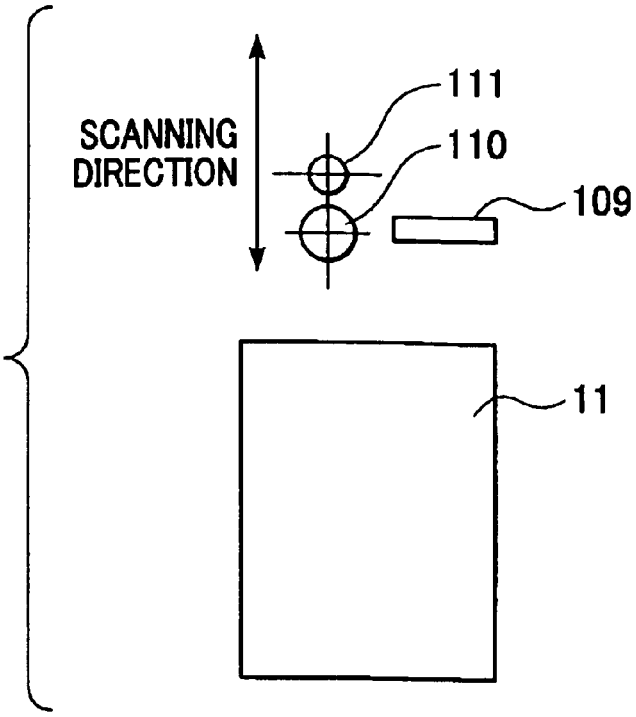
FIG. 8 is a planar displacement diagram of an example of an apparatus wherein a measurement device has been provided adjacent to a head, on a line orthogonal to the scanning direction of a substrate.

As yet another placement example, the head and measurement means may be disposed so as to be alongside in a direction orthogonal to the direction of scanning the substrate with regard to the head and measurement means, as shown in FIG. 8. In this case, there is the need to perform a scan for the measurement means to measure the first line for discharge, to measure the desired position on the substrate and store this position. Subsequently, the substrate is moved in a direction orthogonal to the direction of scanning the substrate as to the head and measurement means (this movement will be referred to as "step movement")m following which the actions of the position control step and discharge step are carried out.

In either case, droplets are discharged on the substrate within a scanning distance range including immediately below the ink-jet head by this scanning (in the X direction, for example), following which movement is made in a direction orthogonal to the scanning direction (Y direction) by a desired amount (step movement), and the substrate is relatively scanned as to the head at that position in the X direction while repeating the position control step and discharging step. This repetition allows droplets to be discharged at high speed and high precision on large-area substrates greater than the length of the head.

First Embodiment

FIG. 1 is a schematic drawing of a fabrication apparatus for an electron source substrate according to a first embodiment of the present invention.

In FIG. 1, reference numeral 101 denotes a main unit bed for loading the apparatus, 102 denotes a vibration-free base for cutting out external vibrations, 103 denotes a Y-stage guide shaft provided on the bed, for performing major strokes, 104 denotes a linear motor for a Y stage, 105 denotes a Y stage functioning as a guide shaft for an X stage, 106 denotes an X-stage driving linear motor, 107 denotes an X stage functioning as a θ shaft, 108 denotes a plate for placing a substrate upon, 109 denotes a head unit configured of an ink-jet head, 110 denotes an XY measurement optical system for measuring pattern positions on the substrate (XY directional), 111 is a Z measurement optical system for measuring positions in the Z direction on the substrate, 112 is a Z movement unit for moving an alignment measurement optical system in the Z direction, 113 denotes a head movement unit for moving the head unit 109 in directions orthogonal to the scanning direction of the substrate, i.e., in the Y and Z directions orthogonal to the X direction, 114 denotes a column for supporting the Z direction movement unit and the head movement unit, 115 denotes a laser optical system for measuring stage position, and 116 denotes a cleaning unit and driving system for cleaning the discharge nozzle face of the ink-jet head to stabilize the amount of discharge and the discharge position.

Figure 2:
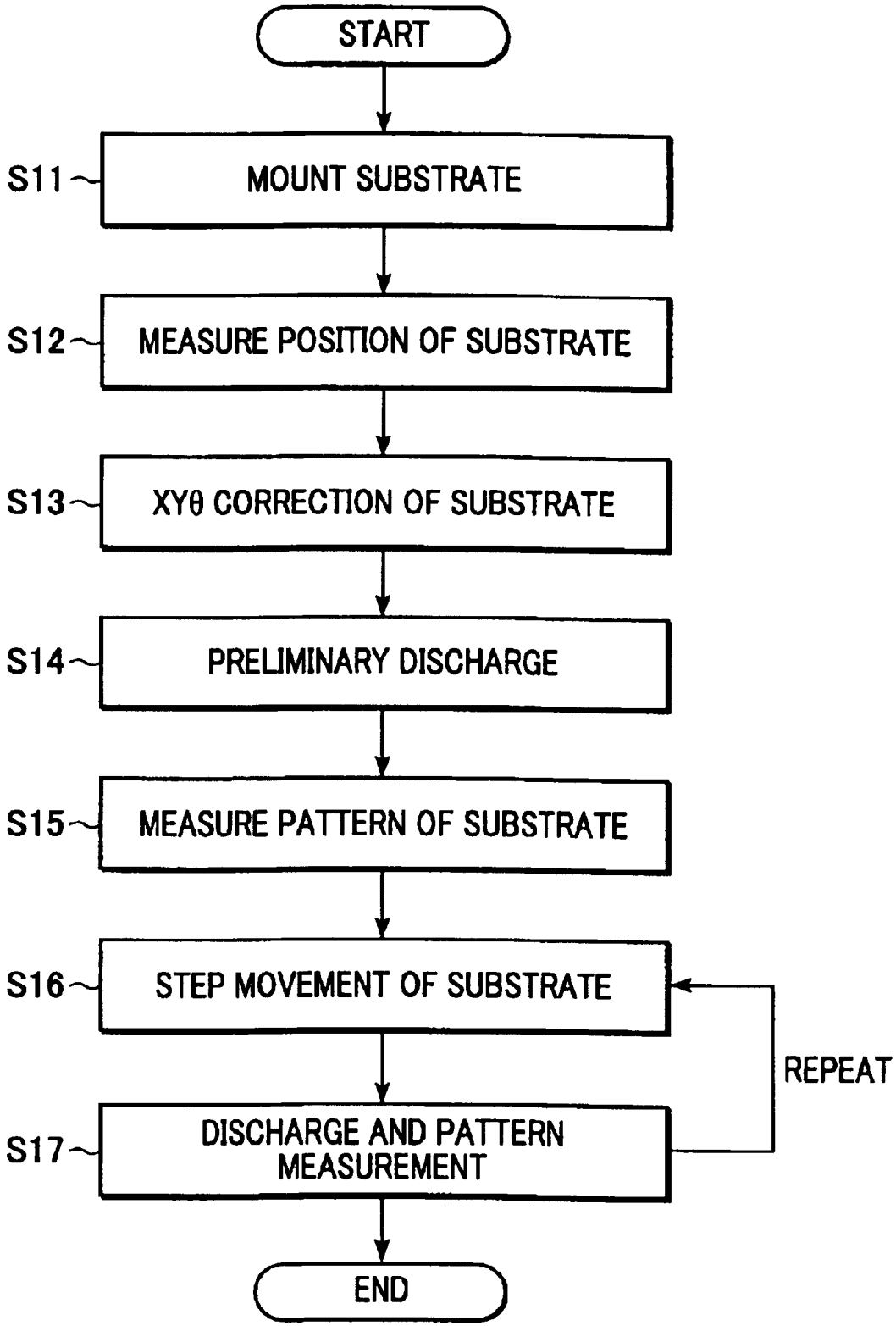
FIG. 2 is a flowchart for describing a manufacturing method for an electron source substrate with the fabrication apparatus.

FIG. 2 is a flowchart for describing a manufacturing method for an electron source substrate with the fabrication apparatus.

Step S11

A substrate to become the electron source substrate is loaded onto the XY stage of the present fabrication apparatus, and is suctioned by vacuum.

Step S12

The upper face of the substrate is measured with the Z measurement optical system, and the XY measurement optical system is moved in the Z direction based upon the measurement results thereof, and also the relative positional relation between the substrate and head in the X, Y, and θ directions is measured. As an example of a suitable arrangement, the XY measurement optical system reads alignment marks provided on the substrate with a sensor such as a CCD or the like, and the image information obtained thereby is analyzed at an image processing unit to measure the relative positional relation.

This measurement may be performed using multiple measurement optical systems with regard to multiple marks, or may be performed using a single measurement optical system with regard to multiple marks by moving the substrate on a stage. Also, the patterns of device electrodes and so forth may be read instead of alignment marks.

Step S13

The position of the XY stage is adjusted based on the measurement results obtained in the previous step, and the relative position between the substrate o the stage and the head is corrected.

Step S14

A droplet or droplets are discharged at a predetermined position in order to stabilize the discharge position and amount of discharge of the ink-jet head. Examples of predetermined positions for discharging such droplet include a set area on the substrate or a set area outside of the substrate on the stage, or an arrangement wherein a tray for receiving the discharged droplet is moved to immediately below the head. By examining the surface condition of the head discharging face and adhesion of droplets thereto and so forth, and using later-described recovery functions to clean the discharge face of the head also may be performed to ensure good performance of the ink-jet head. In the event that the position and amount of discharge of the ink-jet head are already stable, this step S14 may be omitted.

Step S15

The substrate is scanning in one direction relative to the Z measurement optical system and the XY measurement optical system (e.g., the X direction), and positions on the substrate in the mutually orthogonal X, Y, and Z directions are measured. Preferably measured are a pattern of multiple positions (not shown) preselected from all device electrode patterns in the area to which droplets are to be discharged from the head in Step S16.

Step S16

The substrate is moved (step movement) to the head in the direction orthogonal to the scanning direction employed in Step S15, i.e., in the Y direction.

Step S17

The head or substrate are relatively moved in one direction (e.g., in the X direction) based on the measurement results of the multiple patterns in the X, Y, and Z direction measured in step S15, while controlling the discharge position of droplets onto the substrate and discharging the droplets from the head at desired positions, and also measuring by X-measurement, Y-measurement, and Z-measurement the position of the next area to discharge droplets in the next step on the substrate, in the X, Y, and Z directions.

Next, the substrate is moved in steps relative to the head, in the direction orthogonal to the scanning direction, i.e., in the Y direction, in the same way as with in Step S16.

Next, as with Step S17, droplets are discharged while scanning the substrate relatively to the head, and while measuring the position of the next area to discharge droplets on the substrate, in the X, Y, and Z directions. Note that control of the discharge position specifically means correcting the discharging timing, correcting the scanning direction, correcting the θ (angle) of the stage, and so forth.

The steps S16 and S17 are subsequently repeated so as to discharge droplets on all desired areas on the substrate. Also note that positional measurement is not always necessary for all three directions of X, Y, and Z; in the event that the precision of the substrate is sufficient, measurement in only the X and Y directions (and θ if necessary) is sufficient. Conversely, in the event that the precision of the array pattern of the device electrodes is sufficient, measurement in the Z direction alone is sufficient. Also, in the event that there is directivity in the offset of array patterns of the device electrodes within the device electrode formation, an arrangement may be made wherein the directivity is taken in to consideration and measurement is made regarding one of the directions of X or Y (and θ if necessary).

Also, an example has been shown with the present embodiment wherein measurement means for the position of the substrate are provided in a Y-directional position of the head, but in other embodiments an arrangement may be conceived for the present invention wherein the measurement means for the position of the substrate are provided in the X-directional position of the head as described above, and in this embodiment, step S15 is included in step S17.

The above-described energization forming is performed on the electroconductive films thus formed, thereby fabricating an electron source substrate having an electron source configured of surface-conductive emission devices. As described above, the above-described embodiment comprises means whereby the position of the discharge of droplets to the substrate is controlled while scanning the head and substrate relatively in one direction (the X direction) based on the measurement results of the multiple patterns on the substrate in the X, Y, and Z directions, and the positions of the area on the substrate to discharge droplets are measured in the mutually orthogonal X, Y, and Z directions, so there is no need to measure the all pattern positions over all areas for discharge onto the substrate beforehand, so the measurement time can be reduced drastically.

Also, recovery means, preliminary aiding means, and so forth, provided for the ink-jet head as configurations of the fabrication apparatus according to the present invention, are desirable since the advantages of the present invention can be obtained in an even more stable manner. Specific examples thereof include ink-jet head capping means, cleaning means, pressurizing or suctioning means, electrothermal converters or other like heating devices, or preliminary heating means formed as a combination thereof, and a preliminary discharge mode separate from the intended discharging; all of these are effective for stable discharging.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fabrication method for an electron source substrate comprises:

a measurement step wherein at least one of a substrate having a plurality of pairs of electrodes on the surface thereof, and measurement means for measuring the position of said substrate in at least one direction of the X, Y, and Z directions of the substrate which are mutually orthogonal, is scanned relatively in one direction, thereby measuring the substrate position;

a control step for controlling a discharge position of droplets to said substrate from an ink-jet head for discharging droplets containing electroconductive thin-film material, based on the results of said measurement step; and a discharge step for discharging droplets containing electroconductive thin-film material from said ink-jet head to between pairs of electrodes on the surface of said substrate while relatively scanning at least one of said ink-jet head and said substrate in one direction;

wherein the scanning direction in said measurement step and the scanning direction in said discharge step are generally parallel;

and wherein said measurement step and said discharge step are performed in a single scan.

2. A fabrication method for an electron source substrate according to claim 1, wherein said measurement means and said ink-jet head are integrally formed.

3. A fabrication method for an electron source substrate according to claim 2, wherein said measurement means and said ink-jet head are disposed in parallel to the scanning direction in said measurement step or said discharge step.

4. A fabrication method for an electron source substrate according to claim 2, wherein said measurement means and said ink-jet head are disposed orthogonal to the scanning direction in said measurement step or said discharge step.

5. A fabrication method for an electron source substrate according to claim 1, wherein a discharge timing of droplets from said ink-jet head is controlled in said control step.

6. A fabrication method for an electron source substrate according to claim 1, wherein the scanning direction of the at least one of said ink-jet head and said substrate being relatively scanned is in one direction controlled in said control step.

7. A fabrication method for an electron source substrate according to claim 1, further comprising a preliminary discharge step for performing preliminary discharge of droplets from said ink-jet head, before said discharge step.

8. A fabrication method for an electron source substrate according to claim 1, wherein said electron source is configured of surface-conduction emission devices.

9. A fabrication method for an electron source substrate according to claim 8, further comprising a forming step for performing energization forming on an electroconductive thin film formed by droplets provided by said discharge step.

* * * * *

UNITED STATES PATENT AND TRADEMARK OFFICE

CERTIFICATE OF CORRECTION

PATENT NO. : 6,852,372 B2
DATED : February 8, 2005
INVENTOR(S) : Horikoshi et al.

It is certified that error appears in the above-identified patent and that said Letters Patent is hereby corrected as shown below:

Column 1,
Line 12, “a” should read -- an --.
Line 25, “known;” should read -- known: --.
Line 37, “Devices” J.” should read -- Devices”, J. --.
Line 48, “this” should read -- those --.

Column 4,
Lines 58 and 59-60, “proximately” should read -- approximately --.

Column 5,
Line 63, ““step movement”)m” should read -- “step movement”) --.

Column 6,
Line 66, “o” should read -- or --.

Column 7,
Line 17, “scanning” should read -- scanned --.
Line 32, “Z direction” should read -- Z directions --.
Line 61, “in to” should read -- into --.

Signed and Sealed this

Fourth Day of April, 2006

JON W. DUDAS
*Director of the United States Patent and Trademark Office*